US007584794B2

(12) United States Patent
Butler et al.

(10) Patent No.: US 7,584,794 B2
(45) Date of Patent: Sep. 8, 2009

(54) MECHANICAL AND FLUID JET HORIZONTAL DRILLING METHOD AND APPARATUS

(75) Inventors: Tom Butler, Enumelaw, WA (US); Daniel Alberts, Maple Valley, WA (US); Jeff Honekamp, Tomball, TX (US); Martin Craighead, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 101 days.

(21) Appl. No.: 11/323,683

(22) Filed: Dec. 30, 2005

(65) Prior Publication Data

US 2007/0151766 A1 Jul. 5, 2007

(51) Int. Cl.

| | |
|---|---|
| ***E21B 43/26*** | (2006.01) |
| ***E21B 21/00*** | (2006.01) |
| ***E21B 7/04*** | (2006.01) |
| ***E21B 7/08*** | (2006.01) |

(52) U.S. Cl. ..... 166/308.1; 175/77; 175/78; 166/222; 166/177.5

(58) Field of Classification Search ..... 166/298, 166/222; 175/67, 422, 61, 62, 77, 78; 299/17
See application file for complete search history.

(56) References Cited

U.S. PATENT DOCUMENTS

| | | | | |
|---|---|---|---|---|
| 1,367,042 | A * | 2/1921 | Granville | 175/45 |
| 2,397,070 | A | 3/1946 | Zublin | |
| 2,500,785 | A * | 3/1950 | Arutunoff | 175/78 |
| 2,516,421 | A * | 7/1950 | Robertson | 175/78 |
| 2,539,047 | A * | 1/1951 | Arutunoff | 175/40 |
| 2,778,603 | A | 1/1957 | McCune et al. | |
| 3,640,344 | A | 2/1972 | Brandon | |
| 3,797,590 | A * | 3/1974 | Archibald et al. | 175/213 |
| 3,958,649 | A | 5/1976 | Bull et al. | |
| 4,007,797 | A * | 2/1977 | Jeter | 175/26 |
| 4,047,581 | A | 9/1977 | Erickson | |
| 4,106,577 | A | 8/1978 | Summers | |
| 4,119,160 | A | 10/1978 | Summers et al. | |
| 4,226,288 | A | 10/1980 | Collins, Jr. | |
| 4,306,627 | A | 12/1981 | Cheung et al. | |
| 4,307,786 | A * | 12/1981 | Evans | 175/231 |
| 4,317,492 | A | 3/1982 | Summers et al. | |
| 4,343,369 | A | 8/1982 | Lyons et al. | |

(Continued)

OTHER PUBLICATIONS

William C. Maurer & Joe K. Heilhecker, Hydraulic Jet Drilling, Society of Petroleum Engineers of AIME, Paper No. SPE 2434, 1969, pp. 213-224.

(Continued)

*Primary Examiner*—David J Bagnell
*Assistant Examiner*—Cathleen R Hutchins
(74) *Attorney, Agent, or Firm*—Bracewell & Giuliani LLP

(57) ABSTRACT

A device useful for conducting lateral or transverse excavating operations within a wellbore comprising a rotating drill bit with jet nozzles on a flexible arm. The arm can retract within the housing of the device during deployment within the wellbore, and can be extended from within the housing in order to conduct excavation operations. A fluid pressure source for providing ultra high pressure to the jet nozzles can be included with the device within the wellbore. The device includes a launch mechanism that supports the arm during the extended position and a positioning gear to aid during the extension and retraction phases of operation of the device.

23 Claims, 2 Drawing Sheets

U.S. PATENT DOCUMENTS

| | | | | |
|---|---|---|---|---|
| 4,369,850 | A | 1/1983 | Barker | |
| 4,478,295 | A | 10/1984 | Evans | |
| 4,518,048 | A | 5/1985 | Varley | |
| 4,527,639 | A * | 7/1985 | Dickinson, III et al. | 175/61 |
| 4,534,427 | A | 8/1985 | Wang et al. | |
| 4,624,327 | A | 11/1986 | Reichman | |
| 4,787,465 | A | 11/1988 | Dickinson, III et al. | |
| 4,852,668 | A * | 8/1989 | Dickinson, III et al. | 175/67 |
| 4,991,667 | A | 2/1991 | Wilkes, Jr. et al. | |
| 5,056,595 | A * | 10/1991 | Desbrandes | 166/100 |
| 5,197,783 | A * | 3/1993 | Theimer et al. | 299/17 |
| 5,246,080 | A | 9/1993 | Horvei et al. | |
| 5,253,718 | A * | 10/1993 | Lawler | 175/20 |
| 5,255,750 | A | 10/1993 | Wilkes, Jr. et al. | |
| 5,402,855 | A * | 4/1995 | Gondouin | 175/21 |
| 5,429,036 | A * | 7/1995 | Latos | 91/181 |
| 5,439,066 | A | 8/1995 | Gipson | |
| 5,553,680 | A | 9/1996 | Hathaway | |
| 5,632,604 | A | 5/1997 | Poothodiyil | |
| 5,687,806 | A | 11/1997 | Sallwasser et al. | |
| 5,699,866 | A | 12/1997 | Cousins et al. | |
| 5,771,984 | A | 6/1998 | Potter et al. | |
| 5,853,056 | A | 12/1998 | Landers | |
| 5,879,057 | A | 3/1999 | Schwoebel et al. | |
| 5,911,283 | A | 6/1999 | Cousins et al. | |
| 5,934,390 | A | 8/1999 | Uthe | |
| 5,944,123 | A | 8/1999 | Johnson | |
| 6,125,949 | A | 10/2000 | Landers | |
| 6,142,246 | A | 11/2000 | Dickinson, III et al. | |
| 6,167,968 | B1 * | 1/2001 | Allarie et al. | 166/298 |
| 6,189,629 | B1 | 2/2001 | McLeod et al. | |
| 6,206,112 | B1 | 3/2001 | Dickinson, III et al. | |
| 6,263,984 | B1 | 7/2001 | Buckman, Sr. | |
| 6,283,230 | B1 * | 9/2001 | Peters | 175/67 |
| 6,289,998 | B1 | 9/2001 | Krueger et al. | |
| 6,470,978 | B2 | 10/2002 | Trueman et al. | |
| 6,510,907 | B1 | 1/2003 | Blange | |
| 6,578,636 | B2 | 6/2003 | Mazorow et al. | |
| 2002/0011357 | A1 * | 1/2002 | Trueman et al. | 175/67 |
| 2002/0062993 | A1 | 5/2002 | Billingsley | |
| 2003/0164253 | A1 | 9/2003 | Trueman et al. | |
| 2003/0213590 | A1 * | 11/2003 | Bakke et al. | 166/55.3 |
| 2005/0279499 | A1 | 12/2005 | Tarvin et al. | |
| 2006/0113114 | A1 * | 6/2006 | Jin et al. | 175/67 |

OTHER PUBLICATIONS

S.E. Forman & G.A. Secor, The Mechanics of Rock Failure Due to Water Jet Impingement, Society of Petroleum Engineers Journal, Paper No. SPE 4247, 1974, pp. 10-18.

K.K. Lafleur & A.K. Johnson, Well Stimulation in the North Sea: A Survey, Society of Petroleum Engineers of AIME, Paper No. SPE 4315, 1973, pp. 1-7.

John C. Fair, Development of High Pressure Abrasive Jet Drilling, Society of Petroleum Engineers of AIME, Paper No. SPE 8442, 1979, pp. 1-12.

Li Kexlang, Present Status and Future Trends of Jet Bit Drilling in China, Society of Petroleum Engineers, Paper No. SPE 14856, 1986, pp. 241-248 and 265-266.

Shen Zhonghou & Sun Qingxiao, A Study on the Pressure Attenuation of Submerged Non-Free Jet and a Method of Calculation for Bottom Hole Hydraulic Parameters, Society of Petroleum Engineers, Paper No. SPE 14869, 1986, pp. 521-524.

T. Butler, P. Fontana & R. Otta, A Method for Combined Jet and Mechanical Drilling, Society of Petroleum Engineers, Paper No. SPE 20460, 1990, pp. 561-565.

T-Y. Hsia & L.A. Behrmann, Perforating Skin as a Function of rock Permeability and Underbalance, Society of Petroleum Engineers, Paper No. SPE 22810, 1991, pp. 503-510.

L.A. Behrmann, J.K. Pucknell & S.R. Bishop, Effects of Underbalance and Effective Stress on Perforation Damage in Weak Sandstone: Initial Results, Society of Petroleum Engineers, Paper No. 24770, 1992, pp. 81-90.

W.J. Winters, H.B. Mount, P.J. Denitto & M.W. Dykstra, Field Tests of a Low-Cost Lateral Drilling Tool, Society of Petroleum Engineers/IADC, Paper No. SPE/IADC 25748, 1993, pp. 1-17.

Wade Dickinson, H. Dykstra, R. Norlund, Wayne Dickinson, Coiled-Tubing Radials Placed by Water-Jet Drilling: Field Results, Theory, and Practice, Society of Petroleum Engineers, Paper No. SPE 26348, 1993, pp. 343-355.

A.D. Peters & S.W. Henson, New Well Completion and Stimulation Techniques Using Liquid Jet Cutting Technology, Society of Petroleum Engineers, Paper No. SPE 26583, 1993, pp. 739-745.

M.A. Parker, S. Vitthal, A. Rahimi, J.M. McGowen & W.E. Martch Jr., Hydraulic Fracturing of High-Permeability Formations to Overcome Damage, Society of Petroleum Engineers, Paper No. SPE 27378, 1994, pp. 329-344.

S.D. Veenhuizen, T.A. O'Hanion, D.P. Kelley, J.A. Duda & J.K. Aslakson, Ultra-High Pressure Down Hole Pump for Jet-Assisted Drilling, Society of Petroleum Engineers, Paper No. IADC/SPE 35111, 1996, pp. 559-569.

S.D. Veenhuizen, J.J. Koile, C.C. Rice & T.A. O'Hanion, Ultra-High Pressure Jet Assist Mechanical Drilling, Society of Petroleum Engineers, Paper No. SPE/IADC 37579, 1997, pp. 79-90.

S.D. Veenhuizen, DL.L. Stang, D.P. Kelley, J.R. Duda & J.K. Aslakson, Development and Testing of Downhole Pump for High-Pressure Jet-Assist Drilling, Society of Petroleum Engineers, Paper No. SPE 38581, 1997, pp. 1-8.

James S. Cobbett, Sand Jet Perforating Revisited, Society of Petroleum Engineers, Paper No. SPE 39597, 1998, pp. 703-715.

P. Buset, M. Riiber & A. Eek, Jet Drilling Tool: Cost-Effective Lateral Drilling Technology for Enhanced Oil Recoverty, Society of Petroleum Engineers, Paper No. SPE 68504, 2001, pp. 1-9.

A. Gupta, D.A. Summers, & S.V. Chacko, Feasibility of Fluid-Jet Based Drilling Methods for Drilling Through Unstable Formations, Society of Petroleum Engineers, Paper No. SPE/Petroleum Society of CIM/CHOA 78951, 2002, pp. 1-6.

D.A. Summers & R.L. Henry, Water Jet Cutting of Sedimentary Rock, Journal of Petroleum Technology, Jul. 1972, pp. 797-802.

* cited by examiner

MECHANICAL AND FLUID JET HORIZONTAL DRILLING METHOD AND APPARATUS

BACKGROUND OF THE INVENTION

1. Field of the Invention

The invention relates generally to the field of excavation of subterranean formations. More specifically, the present invention relates to a method and apparatus of excavating using a self-contained system disposable within a wellbore. The present invention involves a method and apparatus for excavating using ultra-high pressure fluids. Though the subject invention has many uses, one of its primary uses is to perforate a well and/or stimulate production in that well.

2. Description of Related Art

Wellbores for use in subterranean extraction of hydrocarbons generally comprise a primary section running in a substantial vertical direction along its length. Secondary wellbores may be formed from the primary wellbore into the subterranean rock formation surrounding the primary wellbore. The secondary wellbores are usually formed to enhance the hydrocarbon production of the primary wellbore and can be excavated just after formation of the primary wellbore. Alternatively, secondary wellbores can be made after the primary wellbore has been in use for some time. Typically the secondary wellbores have a smaller diameter than that of the primary wellbores and are often formed in a substantially horizontal orientation.

In order to excavate a secondary wellbore, numerous devices have been developed for lateral or horizontal drilling within a primary wellbore. Many of these devices include a means for diverting a drill bit from a vertical to a horizontal direction. These means include shoes or whipstocks that are disposed within the wellbore for deflecting the drilling means into the formation surrounding the primary wellbore. Deflecting the drilling means can enable the formation of a secondary wellbore that extends from the primary wellbore into the surrounding formation. Examples of these devices can be found in Buckman, U.S. Pat. No. 6,263,984, McLeod et al., U.S. Pat. No. 6,189,629, Trueman et al., U.S. Pat. No. 6,470,978, Hathaway U.S. Pat. No. 5,553,680, Landers, U.S. Pat. No. 6,125,949, Wilkes, Jr. et al., U.S. Pat. No. 5,255,750, McCune et al., U.S. Pat. No. 2,778,603, Bull et al., U.S. Pat. No. 3,958,649, and Johnson, U.S. Pat. No. 5,944,123. One of the drawbacks of utilizing a diverting means within the wellbore however is that the extra step of adding such means within the wellbore can have a significant impact on the expense of such a drilling operation.

Other devices for forming secondary wellbores include mechanical/hydraulic devices for urging a drill bit through well casing, mechanical locators, and a tubing bending apparatus. Examples of these devices can be found in Mazorow et al., U.S. Pat. No. 6,578,636, Gipson, U.S. Pat. No. 5,439,066, Allarie et al., U.S. Pat. No. 6,167,968, and Sallwasser et al., U.S. Pat. No. 5,687,806. Shortcomings of the mechanical drilling devices include the limited dimensions of any secondary wellbores that may be formed with these devices. Drawbacks of excavating devices having mechanical locators and/or tubing bending include the diminished drilling rate capabilities of those devices. Therefore, there exists a need for a device and method for excavating secondary wellbores, where the excavation process can be performed in a single step and without the need for positioning diverting devices within a wellbore previous to excavating. There also exists a need for a device that can efficiently produce secondary wellbores at an acceptable rate of operation.

BRIEF SUMMARY OF THE INVENTION

The present invention includes an excavation system for use in a wellbore comprising an arm extendable into a substantially horizontal position within the wellbore, a pressurized fluid source in fluid communication with the arm, a mechanically rotating source, and a jet nozzle disposed on the end of the arm. The pressurized fluid source is disposed within the wellbore. The jet nozzle has an exit adapted to form a fluid jet suitable for excavating and further adapted to rotate in response to the rotating source. The present invention can also comprise a positioning mechanism in cooperation with the arm. The excavation system of the present invention can further comprise a gear formed for mechanical cooperation with the arm. A drill bit can also be included with the excavation system. A motor can be connected to the pressurized fluid source capable of driving the pressurized fluid source, where the motor can be an electric motor or a mud motor. The pressurized fluid source can be a crankshaft pump, a wobble pump, a swashplate pump, an intensifier, or any combination of these. A wireline can be used to suspend the excavation system within the wellbore. Preferably the arm is flexible and can be articulated. Also, the excavation system can be at least partially submerged in fluid within the wellbore.

The present invention can further comprise a launch mechanism capable of pivotally changing from a first position to a second position. While in the second position the launch mechanism can provide a horizontal base capable of supporting the housing in a horizontal orientation. The horizontal excavation system can further comprise up to four conduits within the housing in fluid communication with the pressurized fluid source.

The present invention can include a method of excavating within a wellbore comprising, forming an excavation system having an arm in fluid communication with a pressurized fluid source, a mechanically rotating source, and a jet nozzle. The arm is extendable into a substantially horizontal position within the wellbore and the jet nozzle is disposed on the end of the arm and has an exit adapted to receive fluid from the pressurized fluid source. Preferably the arm is flexible and can be articulated. The method further includes disposing the excavation system within the wellbore, pressurizing fluid within the wellbore by activating the pressurized fluid source, directing pressurized fluid from the pressurized fluid source to the jet nozzle via the arm, thereby producing a fluid jet exiting said jet nozzle, and urging the arm into the subterranean formation surrounding the wellbore.

The method of the present invention can further include the step of attaching a wireline to the excavation system and the step of forming a drill bit on the end of said arm. The method can further comprise including a positioning mechanism with the excavation system for directing the arm into the subterranean formation surrounding the wellbore. The method can also include the step of connecting a motor to the pressurized fluid source, where the motor can be an electrical motor or a mud motor. The pressurized fluid source can be combined with an intensifier. The pressurized fluid source can be a pump such as a crankshaft pump, a wobble pump, and a swashplate pump. The method of the present invention can further involve including a launch mechanism with the excavation system. The launch mechanism is capable of pivotally changing from a first position to a second position; wherein while in the second position the launch mechanism provides a horizontal base capable of supporting the housing in a horizontal orientation.

Accordingly, one of the advantages provided by the present invention is the ability to readily create excavations within a wellbore that extend lateral from the primary wellbore. Additionally, the present invention includes the capability of disposing a fluid pressure source within the wellbore thereby imparting a greater pressure to the fluid exiting the device.

DETAILED DESCRIPTION OF THE INVENTION

Figure 1:
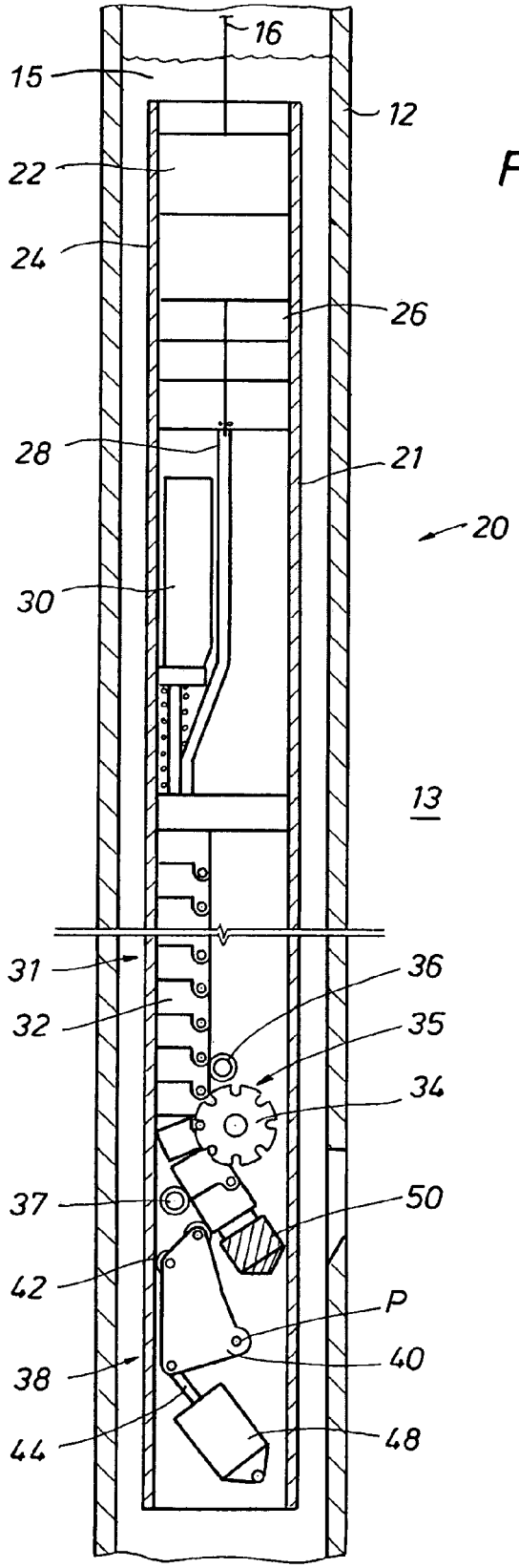
FIG. 1 depicts in partial cross sectional view one embodiment of an excavation system in a retracted position.

The present invention includes a method and apparatus useful for excavating and forming subterranean wellbores, including secondary wellbores extending laterally from a primary wellbore. With reference to FIG. 1, one embodiment of an excavation system 20 of the present invention is shown disposed within a wellbore 12. The embodiment of the excavation system 20 illustrated in FIG. 1 comprises a motor 22 in mechanical cooperation with a pressurized fluid source disposed within a housing 21. In the embodiment of the invention of FIG. 1, the pressurized fluid source is a pump unit 24. At least one conduit 28 is shown connected on one end to the discharge of the pump unit 24 and on the other end to a drill bit 50. Optionally an intensifier 26 can be included to work in cooperation with the pump unit 24 for increasing the pressure of the fluid exiting the pump unit 24. An arm 31 is provided that houses a length of the conduit 28 and terminates at the drill bit 50. The conduit 28 provides a fluid flow path from the discharge of the pump unit 24 or optional intensifier 26 to the drill bit 50. The conduit 28 can be comprised of hose, flexible hose, tubing, flexible tubing, ducting, or any other suitable means of conveying a flow of pressurized fluid.

The excavation system 20 is operable downhole and can be partially or wholly submerged in the fluid 15 of the wellbore 12. The fluid 15 can be any type of liquid, including water, brine, diesel, alcohol, water-based drilling fluids, oil-based drilling fluids, and synthetic drilling fluids. In one embodiment, the fluid 15 is the fluid that already exists within the wellbore 12 prior to the operation. Accordingly, one of the many advantages of the present invention is its ability to operate with clean fluid or fluid having foreign matter disposed therein.

In an alternative embodiment, the wellbore 12 is filled with an etching acidic solution to accommodate the operation. In such a scenario, the acid used may be any type of acid used for stimulating well production, including hydrofluoric or hydrochloric acid at concentrations of approximately 15% by volume. Though the type of fluid used may vary greatly, those skilled in the art will appreciate that the speed and efficiency of the drilling will depend greatly upon the type and characteristics of the fluid employed. Accordingly, it may be that liquid with a highly polar molecule, such as water or brine, may provide additional drilling advantage.

In the embodiment of FIG. 1, the motor 22 is adjacent to the pump unit 24 and an integral part of the excavation system 20. Preferably the motor 22 is an electric motor driven by an electrical source (not shown) located at the surface above the wellbore 12, though the electrical source could also be situated somewhere within the wellbore 12, such as proximate to the motor 22. Alternatively, the electrical source could comprise a battery combined with or adjacent to the motor 22. Types of motors other than electrical, such as a mud motor, can be employed with the present invention. Optionally, the motor 22 could be placed above the surface of the wellbore 12 and connected to the pump unit 24 via a crankshaft (not shown). It is well within the capabilities of those skilled in the art to select, design, and implement types of motors that are suitable for use with the present invention.

As previously noted, the excavation system 20 is at least partially submerged within wellbore fluid 15, the pump unit 24 includes a suction side 25 in fluid communication with the wellbore fluid 15. During operation, the pump unit 24 receives the wellbore fluid 15 through its suction side 25, pressurizes the fluid, and discharges the pressurized fluid into the conduit 28. While the discharge pressure of the pump unit 24 can vary depending on the particular application, the pump unit 24 should be capable of producing pressures sufficient to aid in subterranean excavation by lubricating the drill bit 50 and clearing away cuttings produced during excavation. The pump unit 24 can be comprised of a single fluid pressurizing device or a combination of different fluid pressurizing devices. The fluid pressurizing units that may comprise the pump unit 24 include, an intensifier, centrifugal pumps, swashplate pumps, wobble pumps, a crankshaft pump, and combinations thereof.

Figure 4:
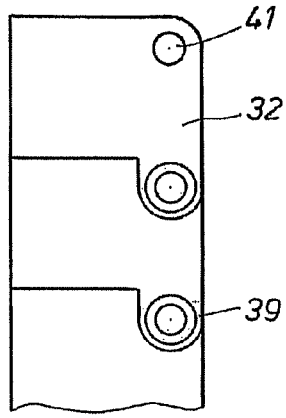
FIG. 4 is a side view of an arm of one embodiment of an excavation system.
Figure 3:
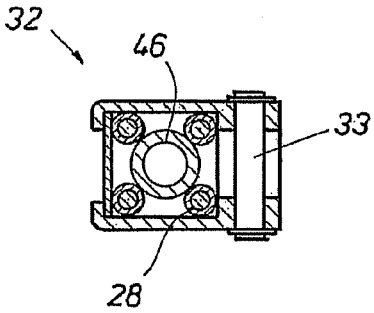
FIG. 3 portrays a cross sectional view of an arm of an embodiment of an excavation system.

With reference now to the arm 31 of the embodiment of the invention of FIG. 1, the arm 31 is comprised of a series of generally rectangular segments 32. As seen in FIG. 4, each segment 32 includes a tab 39 (more preferably a pair of tabs 39 disposed on opposite and corresponding sides of the segment 32) extending outward from the rectangular portion of the segment 32 and overlapping a portion of the adjoining segment 32. An aperture 41, capable of receiving a pin 33, is formed through each tab 39 and the portion of the segment 32 that the tab 39 overlaps. Positioning the pin 33 through the aperture 41 secures the tab 39 to the overlapped portion of the adjoining segment 32 and pivotally connects the adjacent segments 32. Strategically positioning the tabs 39 and apertures 41 on the same side of the arm 31 results in an articulated arm 31 that can be flexed by pivoting the individual segments 32. A drill bit 50 is provided on the free end of the arm 31. As will be described in more detail below, flexure of the arm 31 enables the drill bit 50 to be put into a position suitable for excavation of the wellbore 12.

Figure 2:
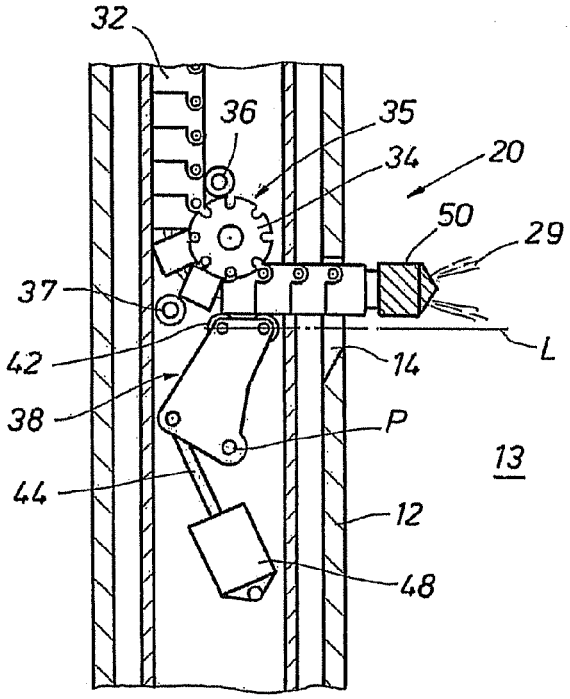
FIG. 2 illustrates in partial cross sectional view an embodiment of an excavation system in an extended position.

The excavation system 20 is suspended within a wellbore 12 via a wireline 16 to the location where excavation is desired. In the context of this application, the wireline 16, a slickline, coil tubing and all other methods of conveyance down a wellbore are considered equivalents. Properly positioning the excavation system 20 at the desired location within the wellbore 12 is well within the capabilities of those skilled in the art. With reference now to FIGS. 1 and 2, the arm 31 of FIG. 1 is in the stored or retracted position. In contrast the arm 31 as shown in FIG. 2 is in the extended or operational position. Once it has been determined that the excavation system 20 is properly positioned, the arm 31 can be changed from the stored into the extended position.

Launching the arm 31 into the operational mode involves directing or aiming the drill bit 50 towards a portion of the subterranean formation 13 where excavation is to be performed. The arm 31 is also extended outward such that the drill bit 50 exits the housing 21 into contact with the subterranean formation 13. A launch mechanism 38 is used to aim the drill bit 50 for excavating contact within the wellbore 12. The launch mechanism 38 comprises a base 40 pivotally connected to an actuator 48 by a shaft 44 and also pivotally connected within the housing 21 at pivot point P. Rollers 42 are provided on adjacent corners of the base 40 such that when the arm 31 is in the retracted position a single roller 42 is in contact with the arm 31. Extension of the shaft 44 outward from the actuator 48 pivots the base 40 about pivot point P and puts each roller 42 of the launch mechanism 38 in supporting contact with the arm 31. The presence of the rollers 42 against the arm 31 support and aim the drill bit 50 so that it is substantially aligned in the same direction of a line L connecting the rollers 42.

Although the embodiment of the invention of FIG. 2 illustrates a drill bit 50 that is positioned substantially horizontal, the drill bit 50 can be situated at any angle lateral to the wellbore 12. As will be appreciated by those skilled in the art, the direction of the arm 31 extending from the housing 21 can be adjusted by the changing the pivot of the base 40 about the pivot point P. A positioning mechanism comprising a gear 34 with detents 35 on its outer radius and idler pulleys (36 and 37) is provided to help guide the arm 31 as it is being retracted and extended. The detents 35 receive the pins 33 disposed on each segment 32 and help to track the arm 31 in and out of its respective retraction/extension positions, and the idler pulleys (36 and 37) ease the directional transition of the arm 31 from a substantially vertical position to substantially lateral orientation as the segments 32 pass by the gear 34. Optionally the gear 34 can be motorized such that it can be used to drive the arm 31 into a retracted or extended position utilizing the interaction of the detents 35 and pins 33.

While aiming or directing the drill bit 50 is accomplished by use of the launch mechanism 38, extending the arm 31 from within the housing 21 is typically performed by a drive shaft 46 disposed within the arm 31. The drive shaft 46 is connected on one end to a drill bit driver 30 and on its other end to the drill bit 50. The drill bit driver 30 can impart a translational up an down movement onto the drive shaft 46 that in turn pushes and pulls the drill bit 50 into and out of the housing 21. The drill bit driver 30 also provides a rotating force onto the drive shaft 46 that is transferred by the drive shaft 46 to the drill bit 50. Since the drive shaft 46 is disposed within the arm 31, it must be sufficiently flexible to bend and accommodate the changing configuration of the arm 31. In addition to being flexible, the drive shaft 46 must also possess sufficient stiffness in order to properly transfer the rotational force from the drill bit driver 30 to the drill bit 50.

In operation, the arm 31 is transferred from the retracted into an extended position by actuation of the launch mechanism 38 combined with extension of the drive shaft 46 by the drill bit driver 30. Before the drill bit 50 contacts the subterranean formation 13 that surrounds the wellbore 12, the motor 22 is activated and the drill bit driver 30 begins to rotate the drill bit 50. As previously noted, activation of the motor 22 in turn drives the pump unit 24 causing it to discharge pressurized wellbore fluid 15 into the conduit 28 that carries the pressurized fluid onto the drill bit 50. The pressurized fluid exits the drill bit 50 through nozzles (not shown) to form fluid jets 29. Excavation within the wellbore 12 can be performed with the present invention by urging the drill bit 50 against the subterranean formation 13. The drill bit 50 can be pushed into the formation 13 by activation of the drive shaft 46, by operation of the gear 34, or a combination of both actions. Excavation with the present invention is greatly enhanced by combining the fluid jets 29 exiting the drill bit 50 with the rotation of the drill bit 50. The fluid jets 29 lubricate and wash away cuttings produced by the drill bit 50 thereby assisting excavation by the drill bit 50, furthermore the force of the fluid jets 29 erodes away formation 13 itself. Continued erosion of the formation 13 by the present invention forms a lateral wellbore into the formation 13, where the size and location of the lateral wellbore is adequate to drain the formation 13 of hydrocarbons entrained therein.

One of the advantages of the present invention is the ability to generate fluid pressure differentials downhole within a wellbore 12 eliminating the need for surface-located pumping devices and their associated downhole piping. Eliminating the need for a surface mounted pumping system along with its associated connections further provides for a safer operation, as any failures during operation will not endanger life or the assets at the surface. Furthermore, positioning the pressure source proximate to where the fluid jets 29 are formed greatly reduces dynamic pressure losses that occur when pumping fluids downhole. Additionally, disposing the pressure source within the wellbore 12 eliminates the need for costly pressure piping to carry pressurized fluid from the surface to where it is discharged for use in excavation.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellbore excavation system comprising:

a housing disposable within a wellbore on a wireline;

an arm disposed within the housing and selectably extendable from within the housing into a position within the wellbore;

a pressurized fluid source within the housing and in fluid communication with said arm the pressurized fluid source having a suction side selectively in fluid communication with wellbore fluid;

a rotating source within the housing;

a rotating drill bit on the end of the arm, the rotating is relative to the arm; and a rotating jet nozzle disposed on the rotating drill bit and coupled to the rotating source.

2. The excavation system of claim 1 further comprising a positioning mechanism in cooperation with said arm.

3. The excavation system of claim 2, wherein said positioning mechanism comprises a gear formed for mechanical cooperation with said arm.

4. The excavation system of claim 1 further comprising a motor connected to said pressurized fluid source capable of driving said pressurized fluid source.

5. The excavation system of claim 4, wherein said motor is selected from the group consisting of an electric motor and a mud motor.

6. The excavation system of claim 1, wherein said pressurized fluid source is comprised of a fluid pump working in combination with an intensifier, and wherein the pressurized fluid source pressurizes wellbore fluid for delivery of pressurized wellbore fluid to the rotatable nozzle.

7. The excavation system of claim 1, wherein said arm is articulated.

8. The excavation system of claim 1, wherein said wellbore excavation system is at least partially submerged in fluid within the wellbore.

9. The excavation system of claim 1, further comprising a launch mechanism capable of pivotally changing from a first position to a second position, wherein while in said second position said launch mechanism provides a horizontal base capable of supporting said arm in a horizontal orientation.

10. The excavation system of claim 1 further comprising up to four conduits within said housing in fluid communication with the pressurized fluid source.

11. The excavation system of claim 1, wherein said system is capable of draining hydrocarbons entrained within a formation adjacent the wellbore.

12. The wellbore excavation system of claim 1, wherein the arm is manipulatable into a position within the wellbore that is substantially perpendicular to the wellbore.

13. The wellbore excavation system of claim 1, wherein the rotating source comprises a motor.

14. The wellbore excavation system of claim 13, wherein the motor is selected from the list consisting of an electrical motor and a mud motor.

15. An excavation system disposable within a wellbore having wellbore fluid, the system comprising:

a housing disposed within the wellbore on a wireline;

an arm disposed within the housing having an end outwardly extendable from within the housing;

a rotating drill bit disposed on the outwardly extendable end of said arm, the rotating is relative to the arm;

at least one conduit within said arm in fluid communication with a downhole pump disposed within the wellbore, the pump having a suction side in fluid communication with the wellbore fluid;

a motor operatively coupled to said pump;

a positioning mechanism coupled to said arm; and a rotating jet nozzle disposed on the end of the rotating drill bit and in fluid communication with said at least one conduit.

16. The excavation system of claim 15, wherein said motor is selected from the group consisting of an electric motor and a mud motor.

17. The excavation system of claim 15, wherein said pump is comprised of a fluid pump working in combination with an intensifier.

18. The excavation system of claim 15 further comprising a launch mechanism that is capable of pivotally changing from a first position to a second position, wherein while in said second position said launch mechanism provides a horizontal base capable of supporting said housing in a horizontal orientation.

19. The excavation system of claim 15, wherein said positioning mechanism comprises a gear formed for mechanical cooperation with said arm.

20. The excavation system of claim 15, wherein the jet nozzle has an exit adapted to form a fluid jet, wherein the jet and rotatable drill bit are suitable for excavating downhole.

21. The excavation system of claim 15, wherein the arm is extendable into the wellbore wall.

22. The excavation system of claim 15 further comprising a drive cable within said arm connected to said drill bit.

23. A method of excavating a formation within a wellbore, the wellbore having wellbore fluid, the method comprising:

disposing an excavation system within the wellbore on a wireline; wherein the excavation system comprises a housing, an arm disposed in the housing and in fluid communication with a pressurized fluid source, a mechanically rotating source, a drill bit connected to the rotating source, and a jet nozzle on the drill bit, wherein said arm is selectively extendable from within the housing into a substantially horizontal position within the wellbore, wherein said jet nozzle is disposed on the end of said arm and has an exit adapted to receive fluid from the pressurized fluid source;

pressurizing wellbore fluid within the wellbore using a pressurizing fluid source disposed in the wellbore;

rotating the drill bit relative to the arm;

contacting the subterranean formation surrounding the wellbore with the rotating drill bit;

discharging pressurized wellbore fluid from the jet nozzle on the drill bit; and directing the pressurized wellbore fluid into the subterranean formation surrounding the wellbore.

* * * * *